US010697186B1

(12) United States Patent
McLaren

(10) Patent No.: US 10,697,186 B1
(45) Date of Patent: Jun. 30, 2020

(54) NON-SLIP SHOWER TILE

(71) Applicant: Errol L. McLaren, Vaughan (CA)

(72) Inventor: Errol L. McLaren, Vaughan (CA)

( * ) Notice: Subject to any disclaimer, the term of this patent is extended or adjusted under 35 U.S.C. 154(b) by 0 days.

(21) Appl. No.: 16/032,443

(22) Filed: Jul. 11, 2018

(51) Int. Cl.
*E04F 15/02* (2006.01)
*A47K 3/12* (2006.01)
*A47K 3/00* (2006.01)

(52) U.S. Cl.
CPC ..... *E04F 15/02172* (2013.01); *A47K 3/125* (2013.01); *E04F 15/02188* (2013.01); *A47K 3/002* (2013.01)

(58) Field of Classification Search
CPC ..... E04F 15/02172; E04F 15/02188; A47K 3/125; A47K 3/002
USPC ..... 52/177
See application file for complete search history.

(56) References Cited

U.S. PATENT DOCUMENTS

D85,859 S * 12/1931 Capouch ..... B28B 3/021 4/581
1,954,940 A * 4/1934 Mikel ..... A47K 7/024 4/575.1
2,274,468 A * 2/1942 Bell ..... A47G 27/0212 112/421
2,604,377 A * 7/1952 Eames ..... A47L 23/24 15/105
2,757,385 A * 8/1956 Whittick ..... A47K 3/40 4/613
3,030,251 A 4/1962 La Bore et al.
3,227,604 A 1/1966 Morgan
3,418,668 A * 12/1968 Anderson ..... A47K 3/002 4/583
3,676,208 A 7/1972 Griffin
3,708,117 A * 1/1973 Coale ..... B60B 39/12 238/14
3,802,144 A * 4/1974 Spica ..... E01C 11/225 52/591.2
3,911,520 A * 10/1975 Tupper ..... A47L 23/24 15/104.92
3,921,350 A * 11/1975 Van Schoyck ..... A47K 3/281 105/375
4,060,947 A * 12/1977 Naka ..... E04F 11/163 52/179
4,239,797 A 12/1980 Sachs
4,336,293 A 6/1982 Eiden
4,512,044 A * 4/1985 Clark ..... A47K 3/002 4/581
D280,611 S * 9/1985 Nelson ..... A46B 11/063 D12/217

(Continued)

*Primary Examiner* — Patrick J Maestri
*Assistant Examiner* — Joseph J. Sadlon
(74) *Attorney, Agent, or Firm* — Sanchelima & Associates, P.A.; Christian Sanchelima; Jesus Sanchelima

(57) ABSTRACT

A non-slip shower tile comprising a rectangular base member, an abrasive surface, and at least two ribbed surfaces. The rectangular base member comprises a non-slip upper surface and a lower surface. The non-slip upper surface is configured to receive a user contact surface, for example, a foot of a user. The lower surface of the rectangular base member is positioned proximal to a floor of a shower area. The abrasive surface is positioned on the non-slip upper surface for removing dry skin or dead skin from the user contact surface. The ribbed surfaces are positioned on opposing edges of the abrasive surface for removing dry skin from the user contact surface.

10 Claims, 2 Drawing Sheets

(56) References Cited

U.S. PATENT DOCUMENTS 4,596,729 A * 6/1986 Morrison ..... E04F 15/10 404/19
4,617,917 A * 10/1986 Miller ..... A46B 3/06 15/104.92
4,620,816 A * 11/1986 Kupfer ..... G09B 21/006 404/6
D331,904 S * 12/1992 Maresca ..... D12/203
5,175,896 A * 1/1993 Zamir ..... A47K 7/024 15/160
5,228,151 A * 7/1993 Livingston-Capoano ..... A47K 3/022 4/571.1
D343,821 S * 2/1994 Bush ..... D12/217
5,293,660 A * 3/1994 Park ..... A46B 5/06 15/160
5,348,686 A * 9/1994 Vyas ..... C08K 13/04 252/512
D359,038 S * 6/1995 Ghassemian ..... A61B 17/54 D14/459
5,520,618 A * 5/1996 Massiet ..... A46B 11/063 132/74.5
5,529,825 A * 6/1996 Sutherland ..... A47L 23/26 428/88
D394,319 S * 5/1998 Berger ..... D25/163
D394,835 S * 6/1998 Crute-Williams ..... D12/203
5,771,522 A * 6/1998 Carmody ..... A47K 7/02 15/104.93
5,778,609 A * 7/1998 Pawson ..... A47L 23/26 15/238
5,913,777 A * 6/1999 Gerber ..... A47K 3/40 52/35
D413,850 S * 9/1999 Wang ..... D12/203
D422,256 S * 4/2000 Lu ..... D12/203
6,053,126 A * 4/2000 Klinger ..... A01K 1/0157 119/526
6,155,629 A * 12/2000 Sherman ..... B32B 3/02 16/4
6,171,269 B1 * 1/2001 Norin ..... A47K 3/002 132/75.6
6,385,795 B1 * 5/2002 Ferber ..... A47K 3/022 4/622
6,389,631 B1 * 5/2002 Keith ..... A47K 7/026 15/104.92
6,526,618 B1 * 3/2003 Bolton ..... A47K 7/024 15/104.92
6,530,096 B1 * 3/2003 Mayhew ..... A47K 3/002 4/580
6,568,000 B1 * 5/2003 Kaufman ..... A47K 3/022 4/541.5
6,632,506 B1 * 10/2003 Grall ..... G02B 5/128 428/141
6,656,565 B2 * 12/2003 Harrison ..... A47K 7/02 15/209.1
6,662,398 B1 * 12/2003 Thomson ..... A47K 7/026 15/104.92
6,663,537 B2 * 12/2003 McCoy ..... A47G 27/0418 482/14
6,673,417 B1 * 1/2004 Gudet ..... B28B 3/021 15/215
6,726,190 B2 * 4/2004 Malpass ..... A47L 23/266 267/136
D490,530 S * 5/2004 Chen ..... A47G 27/0293 D24/211
6,794,013 B1 * 9/2004 Iacovelli ..... B60N 3/044 15/215
D508,132 S * 8/2005 Huang ..... D24/200
7,001,103 B2 * 2/2006 Sippola ..... E01C 19/44 404/75
7,056,569 B2 * 6/2006 Price ..... A47J 47/005 269/289 R
D528,707 S * 9/2006 Deioma ..... A47K 3/022 D30/118
D529,183 S * 9/2006 Cafaro ..... D24/213
7,165,555 B2 * 1/2007 Lee ..... A45D 29/00 132/73.5
7,252,431 B1 * 8/2007 Caramanna ..... G01K 1/14 116/216
7,278,431 B2 * 10/2007 Anderson ..... A61B 17/54 132/76.4
D590,103 S * 4/2009 Hunter ..... D28/63
7,520,003 B2 * 4/2009 Meyers ..... A47K 3/002 4/583
7,578,021 B1 * 8/2009 Figueroa ..... A47K 7/024 15/104.92
7,625,625 B2 * 12/2009 Rios ..... A43B 13/22 428/141
7,634,876 B2 * 12/2009 Moller, Jr. ..... E04F 15/02 404/35
7,832,044 B2 * 11/2010 Kessler ..... A47L 23/266 15/216
8,082,872 B2 * 12/2011 Cook ..... A61H 3/066 116/205
8,181,287 B2 * 5/2012 Luxton ..... A47K 3/40 4/613
8,557,152 B2 * 10/2013 Donald ..... B29C 39/006 264/255
8,656,546 B2 * 2/2014 Wang ..... A47K 7/026 15/104.92
8,764,865 B2 * 7/2014 Boden ..... B24D 3/00 51/309
8,822,014 B2 * 9/2014 Chen ..... A47K 3/16
D717,568 S * 11/2014 Drazin ..... D6/583
D721,850 S * 1/2015 Pottinger ..... A46B 3/06 D28/63
9,033,612 B2 * 5/2015 Szekely ..... A61H 3/066 404/113
D744,119 S * 11/2015 Umbriac ..... E04F 15/02161 D25/158
9,788,674 B2 * 10/2017 Pacione ..... A47G 27/0293
9,873,963 B2 * 1/2018 Scorgie ..... B32B 5/026
9,949,886 B2 * 4/2018 Henshue ..... A61H 3/061
10,125,460 B2 * 11/2018 Szekely ..... A47L 23/24 15/105
D845,546 S * 4/2019 Elbadry ..... A47K 7/024 15/104.92
10,334,993 B1 * 7/2019 Nastasi ..... A47K 7/024 4/575.1
10,391,720 B2 * 8/2019 Malpass ..... B29D 7/00
2007/0022527 A1 * 2/2007 Russo ..... A47K 7/026 4/606
2008/0222794 A1 * 9/2008 Cook ..... A47K 3/40 4/612
2008/0235892 A1 * 10/2008 Williams ..... A47K 7/02 15/210.1
2018/0184854 A1 * 7/2018 Salvatore ..... A47K 3/16

* cited by examiner

NON-SLIP SHOWER TILE

BACKGROUND OF THE INVENTION

1. Field of the Invention

The present disclosure generally relates to personal hygiene products. More particularly, the present disclosure relates to a non-slip shower tile for providing a gripping surface to prevent users from slipping while showering. Furthermore, the non-slip shower tile allows the users to remove dry, dead skin from their feet without requiring bending or an additional hand-held grooming device.

2. Description of the Related Art

Flooring tiles and other hard flooring surfaces are easy to maintain for extended periods. However, most flooring surfaces turn slippery when wet. This is especially dangerous for showering areas of bathrooms, where the showering areas remain wet most of the time. It is estimated that a minimum slip resistant coefficient of approximately 0.2 to 0.25 is required to prevent slipping. The coefficient can be measured following the American Society for Testing and Materials (ASTM) Standard Testing Procedure. Accordingly, several studies have been conducted on anti-slip floor materials.

Typically, flooring tiles or surfaces improve grip by embedding abrasive particles on the surface layer. Such abrasive particles are incorporated into the surface layer by mixing a combination of sand, aluminum oxide, etc., and glazing, spraying or painting on the surface layer. This improves grip when the floor surface is newly glazed or sprayed. Over time, with prolonged use, the abrasive particles are prone to wear and detach from the surface. For elderly users, a task such as showering may be challenging due to the lack of confidence for fear of falling while showering. With growing age, the limbs and extremities of the body may not have the requisite strength to accomplish such tasks without support. A device, which comprises a non-slip surface that is not easily worn out, is therefore required.

U.S. Pat. Nos. 3,227,604, 4,239,797 and 4,336,293, for example, disclose floor materials having grit or particles embedded in or distributed throughout the surface layer. These materials have the drawback that the surface layer, if worn by walking, no longer retains non-slip properties. Furthermore, the embedded particles tend to separate from the surface with time.

U.S. Pat. No. 3,676,208 to Griffin discloses a floor surface wherein glass spheres are incorporated into a surface adhesive film. An epoxy-type resin containing a significant concentration of minuscule solid spheres, such as glass beads, is coated onto a floor surface. This grit-containing epoxy mixture increases the slip resistance of the floor, but it is believed that it does not provide sufficient slip resistance when heavily coated with water or grease.

U.S. Pat. No. 3,030,251 discloses non-slip sheet articles comprising an essentially-continuous, flexible, readily-deformable, rubbery underlying matrix within which a multitude of discrete flexible resilient non-adhesive particles are distributed. However, the particles are not exposed. While the particles have lower abrasion resistance than the matrix layer, they are non-adhesive and are therefore easily releasable.

Another disadvantage of existing products is the lack of abrasive surfaces like a pumice stone provided on flooring surfaces for removal of dry skin or dead skin while showering. Aged users with bad backs find it difficult to bend over to remove dry skin from the feet. A device, which provides a non-slip surface and allows the user to remove dry or dead skin from his/her feet without requiring bending over, is therefore required. As seen above, there exists a need for a device that overcomes the drawbacks and limitations of the art, is of low complexity, has low manufacturing costs and is not prone to defects.

Hence, there is a long felt but unresolved need for a device, which comprises a non-slip surface that is not easily worn out. Moreover, there is a need for a device, which provides a non-slip surface and allows the user to remove dry or dead skin from his/her feet without requiring bending over. Furthermore, there is a need for a device, which is of low complexity, has low manufacturing costs, and is easily customizable.

SUMMARY OF THE INVENTION

The invention, disclosed herein, addresses the above-mentioned need for a device, which comprises a non-slip surface that is not easily worn out. Moreover, the invention addresses the need for a device, which provides a non-slip surface and allows the user to remove dry or dead skin from his/her feet without requiring bending over. Furthermore, the invention addresses the need for a device, which is of low complexity, has low manufacturing costs, and is easily customizable.

The non-slip shower tile comprises a rectangular base member, an abrasive surface, and at least two ribbed surfaces. The rectangular base member comprises a non-slip upper surface and a lower surface. The non-slip upper surface is configured to receive a user contact surface, for example, a foot of a user. The lower surface of the rectangular base member is positioned proximal to a floor of a shower area. The abrasive surface is positioned on the non-slip upper surface for removing dry skin or dead skin from the user contact surface. The ribbed surfaces are positioned on opposing edges of the abrasive surface for removing dry skin from the user contact surface.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
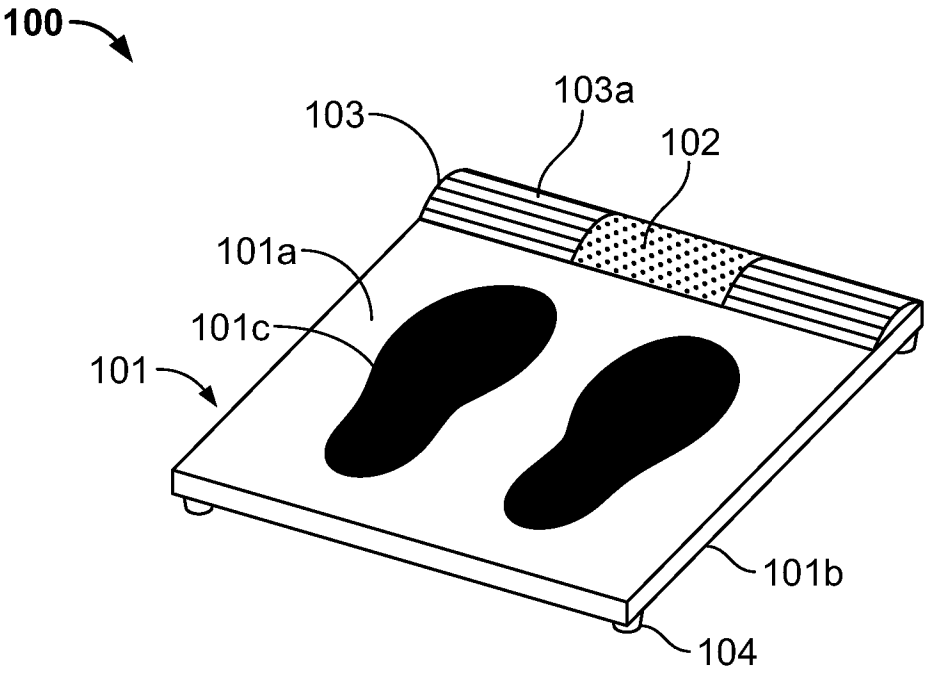
FIG. 1 exemplarily illustrates a perspective view of a non-slip shower tile.

FIG. 1 exemplarily illustrates a perspective view of a non-slip shower tile 100. A non-slip shower tile 100 comprises a rectangular base member 101, an abrasive surface 102, and at least two ribbed surfaces 103. The rectangular base member 101 comprises a non-slip upper surface 101*a* and a lower surface 101*b*. In different embodiments, the rectangular base member 101 may be replaced by a square base, circular base, oval base, elliptical base, triangular base, etc. As used herein, "non-slip upper surface" may be construed to refer to a non-slip material layer that is part of the rectangular base material 101. For example, the non-slip upper surface may include a plurality of ribbed projections, spikes, etc. These ribbed projections or spikes may be arranged in different patterns on the non-slip shower tile 100. Such patterns may include aesthetic designs such as floral patterns, geometric patterns, or the like. Moreover, the spikes or ribbed projections may be configured in a pyramidal geometry, a hemi-spherical geometry, a cuboidal geometry, etc. Alternately, the "non-slip upper surface" may also include a detachable ribbed layer that may be attached to or removed from the non-slip shower tile 100. In such an embodiment, the non-slip upper surface 101*a* may use conventional attachment means for attaching to and detaching from the non-slip shower tile 100. This may include but are not limited to hook and loop fasteners, snap fasteners, or the like. Each of at least two ribbed surfaces 103 include ribbings 103*a* thereon. Each of ribbings 103*a* extend horizontally across each of two ribbed surfaces 103. Ribbings 103*a* may be best seen in FIG. 1 and FIG. 2.

In an embodiment, the non-slip upper surface 101*a* is configured to receive a user contact surface, for example, a foot of a user on predetermined portions 101*c* of the rectangular base member 101. The non-slip upper surface 101*a* provides sufficient grip for the foot of the user while showering. The ribbed projections provide sufficient grip even when the non-slip upper surface 101*a* is wet. The lower surface 101*b* of the rectangular base member 101 is positioned proximal to a floor of a shower area. In the preferred embodiment, the lower surface 101*b* of the non-slip shower tile 101 is positioned approximately 1-inch above the floor of the shower area using rubber pads 104 at four corners of the lower surface 101*b*. Additionally, the non-slip upper surface 101*a* may be configured to slope gradually towards the floor of the shower area. This allows the any residual water to drain off from the non-slip upper surface 101*a*. In an alternate embodiment, the non-slip upper surface 101*a* may be configured to comprise a plurality of drain holes at the predetermined portions 101*c* of the rectangular base member 101. The drain holes may also be positioned throughout the entire non-slip upper surface 101*a* at fixed distances to provide improved water removal from the rectangular base member 101.

Figure 2:
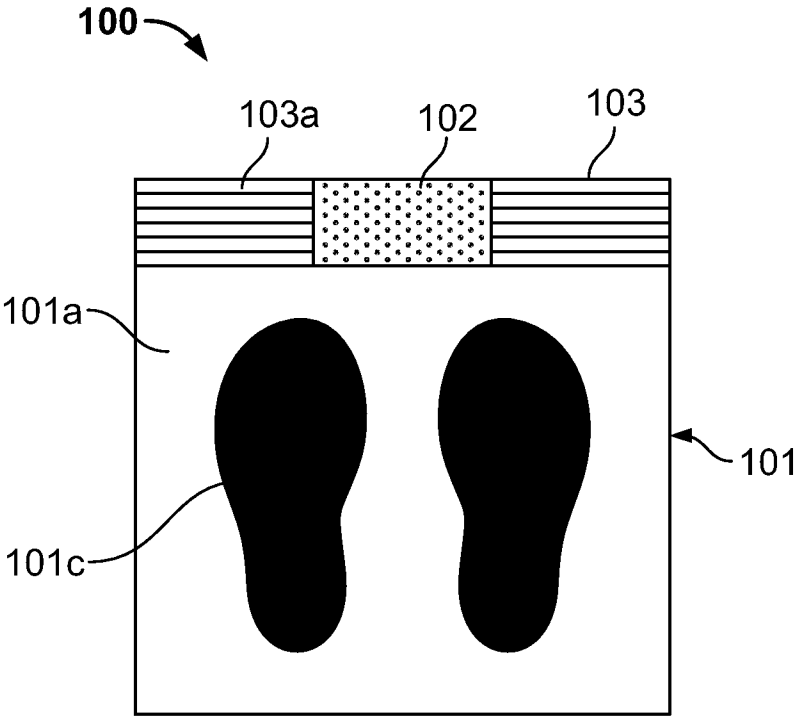
FIG. 2 exemplarily illustrates a top view of a non-slip shower tile.

FIG. 2 exemplarily illustrates a top view of a non-slip shower tile 100. In an embodiment, an abrasive surface 102 and at least two ribbed surfaces 103 are provided on an upper portion of the rectangular base member 101 of the non-slip shower tile 101 as exemplarily illustrated in FIG. 2. It will be appreciated that the abrasive surface 102 and the at least two ribbed surfaces 103 may also be positioned at various other sections of the non-slip upper surface 101*a* of the rectangular base member 101 based on design and utility requirements. A user may place his/her feet at the predetermined portions 101*c* of the rectangular base member 101. Further, the abrasive surface 102 is positioned on the non-slip upper surface 101*a* for removing dry skin or dead skin from the user contact surface. In an embodiment, the abrasive surface 102 may be a hemispherical portion of a pumice stone fixedly attached to the non-slip upper surface 101*a*. As such, the abrasive surface 102 may be employed to remove dead skin or calluses or for more aggressive removal of dead skin. A callus is an area of thickened skin that is formed as a response to repeated friction, pressure, or other irritation. Calluses may form due to wearing incorrectly fitting footwear or due to other reasons. In an embodiment, the abrasive surface 102 and the two ribbed surfaces 103 are slightly raised and rounded to further assist the user with a contour to aid in foot cleaning and dead skin removal.

In an embodiment, the ribbed surfaces 103 are positioned on opposing edges of the abrasive surface 102 for removing dry skin from the user contact surface. The ribbed surfaces 103 are provided for removing dry skin that does not require abrasive force as much as calluses or thicker dead skin. The abrasive surface 102 and the ribbed surfaces 103 are fixedly attached to the rectangular base member 101. In an embodiment, the non-slip shower tile 100 is made of materials such as plastic ceramic, wood, fiberglass or the like. It will be appreciated that the non-slip shower tile 100 may be made of a variety of materials using several manufacturing techniques. For instance, the non-slip shower tile 100 may be made from plastic using injection molding techniques. Alternately, the non-slip shower tile 100 may be formed from a suitable powder composition that forms a ceramic or porcelain tile with non-slip properties, comprising a mixture of clay, feldspar, silica, etc., in varying proportions, as generally known in the art. The powder composition may be spray-dried and then pressed in a mold. The mold may be shaped to create the ribbed exterior surface of the rectangular base member 101 of the non-slip shower tile 100 as disclosed in the detailed description of FIG. 1. The mold produces a non-slip shower tile 100 of a desired shape, which is then fired. It will be appreciated that the non-slip shower tile 100 may be manufactured or formed from any mixture of ingredients known in the art using processes that may be apparent to those skilled in the art.

Figure 3:
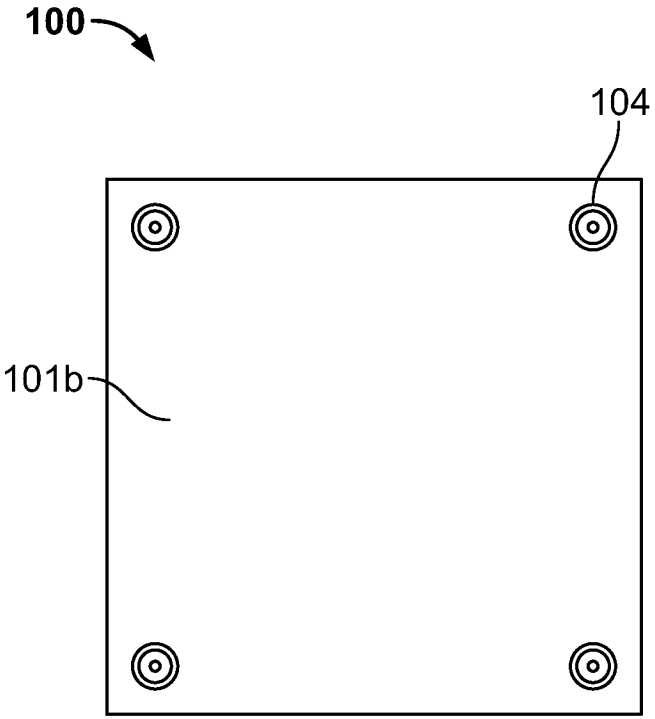
FIG. 3 exemplarily illustrates a bottom view of a non-slip shower tile.

FIG. 3 exemplarily illustrates a bottom view of a non-slip shower tile 100. The lower surface 101*b* of the non-slip shower tile 100 is provided with a set of rubber pads 104 at the four corners of the lower surface 101*b* as exemplarily illustrated in FIG. 3. As such, the rubber pads 104 serve to raise the rectangular base member 101 suitably. In an embodiment, the rubber pads 104 may be of different heights to cause the rectangular base member 101 to gradually slope towards the floor of the shower area. This allows the water on the non-slip shower tile 100 to drain efficiently.

The non-slip shower tile 100 is placed on the floor of the shower. In an embodiment, the rubber pads 104 help elevate the non-slip shower tile 100. The non-slip shower tile 100 encourages safety and peace of mind for users while showering due to its grip and stability. Further, the non-slip shower tile 100 provides elderly users, users with bad backs, etc., with an alternative for easy feet cleaning and dead skin removal without requiring bending over. For elderly users, the non-slip shower tile 100 provides confidence in not falling while showering. Moreover, for diabetic patients who should not have their feet soaking in water for too long, the raised platform helps ensure the water is effectively drained. In the preferred embodiment, the non-slip shower tile 100 has a length and width of 16-inches and a height of approximately 1.5 inches. The non-slip shower tile 100 may be provided in multiple colors and patterns that match the flooring tiles of the shower area.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An anti-skid tile comprising:

a base with a non-slip upper surface for user contact and a lower surface capable of being placed proximal to a floor;

mounted on said non slip upper surface being at least one abrasive surface and a first and second ribbed surface each having a proximal end and a distal end, said at least one abrasive surface, said first ribbed surface and said second ribbed surface being along a top edge of said base and on a same horizontal plane, said at least one abrasive surface, said first ribbed surface and second ribbed surface being in abutting contact with said non slip upper surface, said first and second ribbed surface each having ribbings thereon which extend laterally and parallel to each other, said ribbings on said first ribbed surface being entirely in direct and constant contact with each other, said ribbings on said second ribbed surface also being entirely in direct and constant contact with each other, said ribbings extend entirely across a width of said first and second ribbed surface, said ribbings of said first and second ribbed surface being in constant abutting contact with said at least one abrasive surface at said proximal ends, said proximal ends being flush with said abrasive surface, said distal ends extending to and being flush with the lateral peripheries of said base, said abrasive surface located between said first and second ribbed surface, said abrasive surface adapted to remove dry or dead skin upon contact with a user's feet;

two predetermined portions each having a shape of a foot adapted to receive a user's left and right foot; and a plurality of drain holes positioned throughout an entirety of said non-slip upper surface.

2. The anti-skid tile as claimed in claim 1, wherein geometrical structure of the base is selected from the group consisting of rectangle, square, circular, oval, elliptical, and triangular.

3. The anti-skid tile as claimed in claim 1, wherein said at least one abrasive surface is either curved or flat, and consists of a pumice stone fixedly attached to the non-slip surface.

4. The anti-skid tile as claimed in claim 1, wherein the surface of said anti-skid tile consists of materials with slip resistant coefficient of at least 0.25.

5. The anti-skid tile as claimed in claim 1, wherein said anti-skid tile includes a front side, said abrasive surface and said first and second ribbed surfaces are located at said front side, a first set of rubber pads mounted beneath said lower surface at said front side, a rear side opposite said front side, a second set of rubber pads mounted beneath said lower surface at said rear side, said first set of rubber pads being taller than said second set, thereby raising the base of said anti-skid tile to allow water to run off towards a shower floor.

6. The anti-skid tile as claimed in claim 1, wherein said non-slip upper surface has ribbed projections and/or spikes for receiving the user's feet.

7. The anti-skid tile as claimed in claim 1, wherein each of said ribbings are rectangular and mounted adjacently to one another to form an arched shape.

8. The anti-skid tile as claimed in claim 1, wherein said at least one abrasive surface, first ribbed surface and second ribbed surface being in direct contact with said base.

9. The anti-skid tile as claimed in claim 1, wherein said first and second ribbed surfaces and said abrasive surface each having a semi-circular shape and raised off of said base.

10. The anti-skid tile as claimed in claim 1, wherein said first and second ribbed surfaces each having a thickness.

* * * * *